US005100534A

United States Patent [19]

Le et al.

[11] Patent Number: 5,100,534

[45] Date of Patent: Mar. 31, 1992

[54] HYDROCARBON CRACKING AND REFORMING PROCESS

[75] Inventors: Quang N. Le, Cherry Hill, N.J.; Paul H. Schipper, Wilmington, Del.; Hartley Owen, Belle Mead, N.J.

[73] Assignee: Mobil Oil Corporation, Fairfax, Va.

[21] Appl. No.: 609,553

[22] Filed: Nov. 6, 1990

Related U.S. Application Data

[63] Continuation-in-part of Ser. No. 442,806, Jul. 5, 1990, Pat. No. 4,969,987.

[51] Int. Cl.[5] ..... C10G 63/04; C10G 63/06; C07C 4/06

[52] U.S. Cl. ..... 208/70; 208/79; 208/67; 585/302; 585/304; 585/310; 585/319; 585/324; 568/697

[58] Field of Search ..... 258/67, 69, 79, 70; 585/300, 304, 302, 310, 319, 324; 568/697

[56] References Cited

U.S. PATENT DOCUMENTS

| | | | |
|---|---|---|---|
| 3,753,891 | 8/1973 | Graven | 208/62 |
| 3,759,821 | 9/1973 | Brennan et al. | 208/93 |
| 3,770,614 | 11/1973 | Graven | 208/80 |
| 3,784,463 | 1/1974 | Reynolds et al. | 208/77 |
| 3,935,460 | 5/1960 | Annable et al. | 208/70 |
| 4,162,212 | 7/1979 | Miller | 585/302 |
| 4,738,766 | 4/1988 | Fischer et al. | 208/69 |
| 4,831,195 | 5/1989 | Harandi et al. | 585/304 |
| 4,897,177 | 1/1990 | Madler | 208/79 |
| 4,906,353 | 3/1990 | Breckenridge | 208/70 |
| 4,950,387 | 8/1990 | Harandi et al. | 208/70 |
| 4,969,987 | 11/1990 | Le et al. | 208/67 |
| 5,001,292 | 3/1991 | Harandi et al. | 585/310 |

FOREIGN PATENT DOCUMENTS

0347003A1 6/1989 European Pat. Off. .

*Primary Examiner*—Anthony McFarlane
*Attorney, Agent, or Firm*—Alexander J. McKillop; Charles J. Speciale; L. G. Wise

[57] ABSTRACT

An improved process for upgrading paraffinic naphtha to high octane fuel by contacting a naphtha feedstock, such as virgin naphtha feedstock stream containing predominantly $C_7$–$C_{12}$ alkanes and naphthenes, with solid medium pore acid zeolite cracking catalyst under low pressure selective cracking conditions effective to produce at least 10 wt % selectivity $C_4$–$C_5$ isoalkene. Cracking effluent is separated to obtain a light olefinic fraction rich in $C_4$–$C_5$ isoalkene and a $C_6$+ liquid fraction of enhanced octane value containing less than 50 wt % aromatic hydrocarbons. In a multistage operation enhanced octane products are obtained by etherifying the isoalkene fraction and by contacting the $C_6$+ normally liquid fraction with reforming catalyst under moderate reforming conditions at elevated temperature to obtain a reformate product of enhanced octane value.

17 Claims, 1 Drawing Sheet

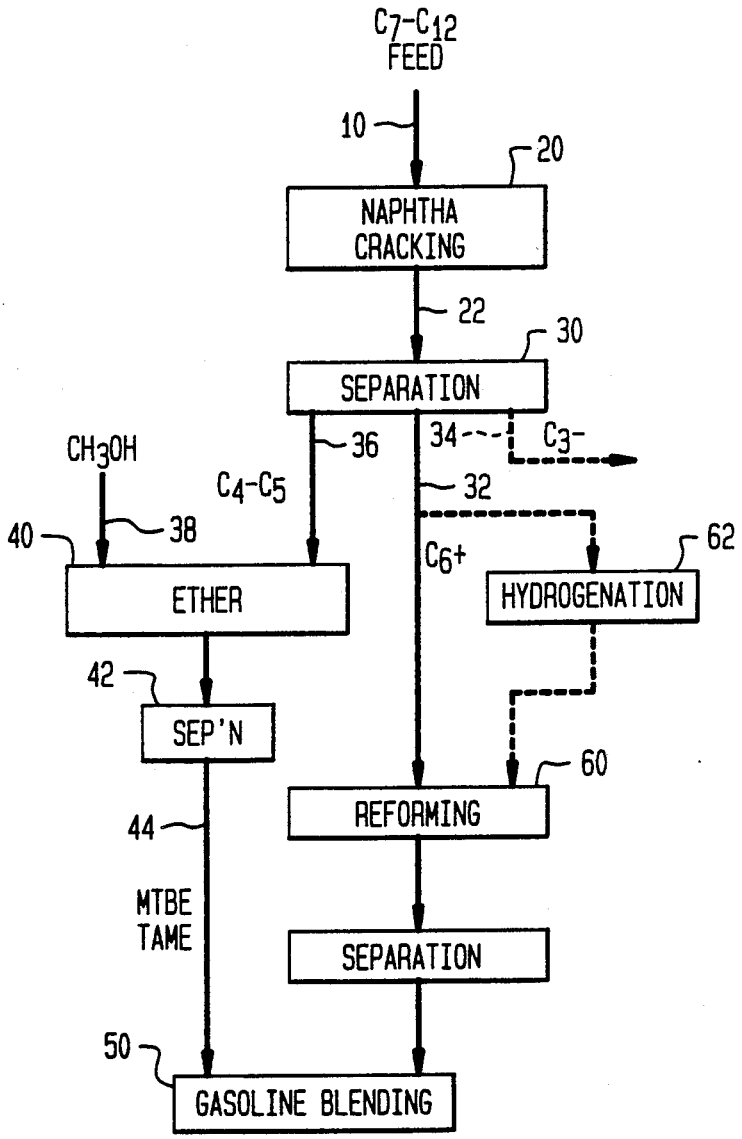
C7-C12
FEED
10
20
NAPHTHA
CRACKING
22
30
SEPARATION
CH3OH
36
34
C3-
C4-C5
32
40
38
62
C6+
ETHER
HYDROGENATION
42
SEP'N
60
44
REFORMING
MTBE
TAME
SEPARATION
50
GASOLINE BLENDING

HYDROCARBON CRACKING AND REFORMING PROCESS

REFERENCE TO COPENDING APPLICATION

This application is a continuation-in-part of U.S. patent application Ser. No. 07/442,806 filed July 5, 1990, now U.S. Pat. No. 4,969,987, incorporated herein by reference.

BACKGROUND OF THE INVENTION

This invention relates to production of high octane fuel from naphtha by hydrocarbon cracking to produce intermediate iso-olefins and upgrading of C6+ hydrocarbons to make high octane gasoline blending components of reduced benzene content. In particular, it relates to methods and reactor systems for cracking $C_7$+ paraffinic and naphthenic feedstocks, such as naphthenic petroleum fractions, under selective reaction conditions to produce intermediates rich in C4–C5 isoalkenes.

There has been considerable development of processes for synthesizing alkyl tertiary-alkyl ethers as octane boosters in place of conventional lead additives in gasoline. The etherification processes for the production of methyl tertiary alkyl ethers, in particular methyl t-butyl ether (MTBE) and t-amyl methyl ether (TAME) have been the focus of considerable research. It is known that isobutylene (i-butene) and other isoalkenes (branched olefins) may be reacted with methanol, ethanol, isopropanol and other lower aliphatic primary and secondary alcohols over an acidic catalyst to provide tertiary ethers Methanol is considered the most important $C_1$–$C_4$ oxygenate feedstock because of its widespread availability and low cost. Therefore, primary emphasis herein is placed on MTBE and TAME and cracking processes for making isobutylene and isoamylene reactants for etherification.

In current refining strategies naphtha reforming provides a major source of high octane gasoline containing very high aromatic levels, including benzene. In the present integrated process, the naphtha feedstock is first partially converted in a cracking reactor containing porous solid catalyst, such as medium and/or large-pore zeolite, to obtain a mixture of light C5− olefins and C6+ hydrocarbons . The iso-olefins such as iso-butene and iso-pentene are separated from the primary effluent for etherification by conventional MTBE/TAME production methods. This processing sequence produces high octane gasoline components while minimizing the overall aromatic content of gasoline pool.

SUMMARY OF THE INVENTION

A novel process and operating technique has been found for upgrading paraffinic feedstock such as C7+ naphthenic naphtha to high octane fuel. The primary reaction for conversion of naphtha is effected by contacting the hydrocarbon feedstock with acid zeolite cracking catalyst under low pressure selective cracking conditions and reaction temperature of about 425° to 650° C. to provide at least 10 wt % selectivity to C4–C5 isoaliphatics. Preferably, the cracking catalyst comprises large or medium pore aluminosilicate zeolite selected from ZSM-5, ZSM-11, ZSM-12, MCM-22, zeolite beta, USY and mixtures thereof with one another, said cracking catalyst being substantially free of hydrogenation-dehydrogenation metal components. Cracking effluent is separated to obtain a light olefinic fraction rich in C4–C5 isoalkene, and a C6+ liquid aliphatic hydrocarbon fraction useful for further upgrading by reforming. With suitable medium and/or large pore zeolites the cracking- dehydrogenation reactions can be controlled to produce at least 40% selectivity of total C4–C5 isoalkenes based on weight of converted naphtha. The preferred fresh feedstock is selected from virgin straight run petroleum naphtha, hydrocracked naphtha, coker naphtha, visbreaker naphtha, and reformer extract raffinate containing at least 15 wt % $C_7$+ cycloaliphatic hydrocarbons and about 1 to 40% aromatics; and the cracking conditions include total pressure up to about 500 kPa, said aluminosilicate zeolite having an acid cracking activity less than 15.

The preferred first stage cracking catalyst comprises metallosilicate zeolite having a constraint index of about 0.4 to 12; and partial cracking conditions are maintained at moderate severity whereby the cracking reaction converts a minor amount of feedstock paraffins and produces less than 5% C2— light gas based on fresh naphtha feedstock.

These and other objects and features of the invention will be understood from the following description and in the drawing.

DRAWING

FIG. 1 of the drawing is a schematic flow sheet depicting a multireactor cracking, reforming and etherification system.

DETAILED DESCRIPTION

Typical naphtha feedstock materials for selective cracking are produced in petroleum refineries by distillation of crude oil. Typical straight run naphtha fresh feedstock usually contains at least about 20 wt % (preferably 25 to 100%) C7–C12 normal and branched alkanes, at least about 15% (preferably about 20 to 50%) C7+ cycloaliphatic (i.e., naphthene) hydrocarbons, and 1 to 40% (preferrably less than 20%) aromatics. The C7–C12 hydrocarbons have a normal boiling range of about 65° to 175° C. The process can utilize various feedstocks such as cracked FCC naphtha, hydrocracked naphtha, coker naphtha, visbreaker naphtha and reformer extraction (Udex) raffinate, including mixtures thereof. For purposes of explaining the invention, discussion is directly mainly to virgin naphtha and methanol feedstock materials.

Referring to FIG. 1 of the drawing, the operational sequence for a typical naphtha conversion process is shown, wherein fresh virgin straight run naphtha feedstock 10 or hydrocracked naphtha is passed to a cracking reactor unit 20, from which the effluent 22 is distilled in separation unit 30 to provide a liquid C6+ hydrocarbon stream 32 containing unreacted naphtha, heavier olefins, etc., a light C3− cracked hydrocarbon stream 34 rich in propylyene, ethylene and C1–C3 aliphatics, an intermediate hydrocarbon stream 36 rich in C4 and C5 linear and branched olefins, including i-butene and i-pentenes, non-etherifiable butylenes and amylenes. At least the C4–C5 isoalkene-containing fraction of effluent stream 36 is reacted with methanol or other alcohol stream 38 in etherification reactor unit 40 by contacting the reactants with an acid catalyst, usually in a fixed bed process, to produce an effluent stream 42 containing MTBE, TAME, byproduct oligomers and unreacted C5− components. Conventional product recovery unit operations 42, such as distillation, extraction, etc. can be employed to recover the MTBE/-TAME ether products as pure materials, or as a C5+ mixture 44 for fuel blending in unit 50. Unreacted light C2–C4 olefinic components, methanol and any other C2–C4 alkanes or alkenes may be recovered from etherication effluent 40 or further upgraded.

Light stream 34 containing propylene, propane, ethylene light gas may be recovered as offgas stream, which may be further processed in a gas plant for recovery of hydrogen, methane, ethane, etc. The propylene may be upgraded to oxygenates, such as di-isopropyl ether or isopropanol and also blended into the gasoline.

A C6+ stream 32, consisting essentially of normally liquid hydrocarbons is recovered from catalytic cracking effluent and further processed by reforming as herein described in reforming reactor unit 60. Optional hydrogenation of all or a portion of stream 32 in hydrotreating reactor 62 can be employed to pretreat reformer feed.

Primary Stage- Zeolite Selective Cracking Catalysts

Careful selection of catalyst components to optimize isoalkene selectivity is important to overall success of the integrated process. The cracking catalyst may consist essentially of ultrastable zeolite Y (USY), beta, ZSM-12 or the like, having an acid cracking activity less than 15 (standard alpha value) and moderately low constraint index (C.I.=0.5–12 or lower). Medium pore zeolites have a pore size of about 5–7 Å, able to accept naphthene components found in most straight run naphtha from petroleum distillation or other alkyl cycloaliphatics. When cracking substantially linear alkanes, the more constrained medium pore structure may be advantageous, especially in admixture with larger pore catalyst components.

Prominent among the intermediate pore size zeolites is ZSM-5, which is usually synthesized with Bronsted acid active sites by incorporating a tetrahedrally coordinated metal, such as Al, Ga, Fe, B or mixtures thereof, within the zeolitic framework. These medium pore zeolites useful for acid catalysis; however, the advantages of medium pore structures may be utilized by employing highly siliceous materials or crystalline metallosilicate having one or more tetrahedral species having varying degrees of acidity. ZSM-5 crystalline structure is readily recognized by its X-ray diffraction pattern, which is described in U.S. Pat. No. 3,702,866 (Argauer, et al.), incorporated by reference.

Zeolite hydrocarbon upgrading catalysts preferred for use herein include the crystalline aluminosilicate zeolites having a silica-to-alumina ratio of at least 12, a constraint index of about 0.4 to 12 and acid cracking activity (alpha value) less than about 15 (e.g., about 1–10 based on total catalyst weight). Representative of the suitable zeolites are ZSM-5, ZSM-11, ZSM-12, ZSM-22, ZSM-23, ZSM-35, ZSM-48, Zeolite Beta, L, MCM-22, SSZ-25 and mixtures thereof with similarly structured catalytic materials. Aluminosilicate ZSM-5 is disclosed in U.S. Pat. No. 3,702,886 and U.S. Pat. No. Re. 29,948. Other suitable zeolites are disclosed in U.S. Pat. Nos. 3,709,979; 3,832,449; 4,076,979; 3,832,449; 4,076,842; 4,016,245; 4,414,423; 4,417,086; 4,517,396; 4,542,257; and 4,826,667. MCM-22 is disclosed in U.S. Pat. No. 4,954,325. These disclosures are incorporated herein by reference. While suitable zeolites having a coordinated metal oxide to silica molar ratio of 20:1 to 500:1 or higher may be used, it is advantageous to employ a standard ZSM-5 or ZSM-12, suitably modified if desired to adjust acidity. A typical zeolite catalyst component having Bronsted acid sites may consist essentially of aluminosilicate zeolite with 5 to 95 wt. % silica and/or alumina binder. The cracking catalyst should be substantially free of hydrogenation-dehydrogenation metal components, such as Pt, Ni, etc.

Larger pore zeolites, such as ultrastable Y (USY), Beta, faujasite, ZSM-20, mordenite, or others having a pore size greater than 7 Å can be employed, especially in admixture with medium pore zeolites. It is found that catalyst containing at least one porous catalyst component having a pore size greater than 7 Å can result in greatly enhanced iso-butane/isopentane selectivity; however, these paraffins must then be dehydrogenated prior to etherification. Under certain circumstances it is feasible to employ the same catalyst for naphtha cracking and downstream optional light olefin upgrading, although these operations may be kept separate with different catalysts being employed. Large pore zeolites, such as Y, beta, mordenite, or others having a pore size greater than 7 Å can be employed.

Usually the zeolite crystals have a crystal size from about 0.01 to 2 microns or more. In order to obtain the desired particle size for fluidization in the turbulent regime, the zeolite catalyst crystals are bound with a suitable inorganic oxide, such as silica, alumina, etc. to provide a zeolite concentration of about 5 to 95 wt %.

It is advantageous to employ a standard zeolite having a silica:alumina molar ratio of 25:1 or greater in a once-through fluidized bed unit to convert 20 to 60 percent, preferably at least 30 wt. %, of the feed in a single pass. Particle size distribution can be a significant factor in transport fluidization and in achieving overall homogeneity in dense bed, turbulent regime or transport fluidization. It is desired to operate the process with particles that will mix well throughout the bed. It is advantageous to employ a particle size range consisting essentially of 1 to 150 microns. Average particle size is usually about 20 to 100 microns.

In addition to the commercial zeolites, acid catalysis can be achieved with aluminophosphates (ALPO), silicoaluminophosphates (SAPO) or other non-zeolitic porous acid catalysts.

Fluidized Catalyst Riser Reactor Cracking Operation

The selective cracking conditions are moderate severity, preferably to convert a minor portion of the feedstock paraffins, e.g. - 15 to 40 wt %. Such conditions include total pressure up to about 500 kPa and reaction temperature of about 425° to 650° C., preferrably at pressure less than 175 kPa and temperature in the range of about 450° to 540° C., wherein the cracking reaction produces less than 5% C2− light gas based on fresh naphtha feedstock. The cracking reaction severity is maintained by employing a weight hourly space velocity of about 0.5 to 100 (WHSV based on active catalyst solids); and corresponding contact time less than 10 seconds (e.g. - about 0.5 to 5, usually about 1–2 sec). While fixed bed, moving bed or dense fluidized bed catalyst reactor systems may be adapted for the cracking step, it is preferred to use a vertical riser reactor with fine catalyst particles being circulated in a fast fluidized bed.

Etherificaton Operation

The reaction of methanol with isobutylene and isoamylenes at moderate conditions with a resin catalyst is known technology, as provided by R. W. Reynolds, et al., *The Oil and Gas Journal.* June 16, 1975, and S. Pecci and T. Floris, *Hydrocarbon Processing,* December 1977. An article entitled "MTBE and TAME - A Good Octane Boosting Combo", by J. D. Chase, et al., *The Oil and Gas Journal,* Apr. 9, 1979, pages 149–152, discusses the technology. A preferred catalyst is a sulfonic acid ion exchange resin which etherifies and isomerizes the reactants. A typical acid catalyst is Amberlyst 15 sulfonic acid resin.

Processes for producing and recovering MTBE and other methyl tert-alkyl ethers for $C_4$–$C_7$ iso-olefins are known to those skilled in the art, such as disclosed in Owen et al U.S. Pat. No. 4,788,365 and in U.S. Pat. No. 4,885,421, incorporated by reference. Various suitable extraction and distillation techniques are known for recovering ether and hydrocarbon streams from etherification effluent; however, it is advantageous to convert unreacted methanol and other volatile components of etherificaton effluent by zeolite catalysis.

Reforming Reactor Operation

Catalytic conversion of aliphatic hydrocarbons by cracking, isomerization, cyclization and dehydrogenation reactions is a well known petroleum refining operation. Using conventional noble metal catalysts, such as platinum or Pt/Rh on alumina, octane improvement is achieved by molecular rearrangements. Conventional reforming operations may employ continuous moving bed catalyst (CCR) or fixed bed swing reactor configurations, and such catalytic reactor systems can be employed in the secondary stage of the present inventive process. Existing reformer can be upgraded by partially cracking the feedstock prior to reforming the C6+ hydrocarbons under less severe conditions. This technique avoids excessive light paraffin formation.

Typical reforming processes are disclosed in U.S. Pat. Nos. 3,476,026 (Derr et al), 3,540,996 (Maziuk et al), 3,649,520 (Graven), 3,669,875 (Plank et al), 4,839,024 (Ramage et al) and 4,927,525 (Chu).

The following examples of naphtha cracking reactions are demonstrated to show selectivity in producing isoalkenes. Unless otherwise indicated, the examples employ standard acid zeolite catalyst. The standard ZSm-12 is steamed to reduce the acid cracking activity (alpha value) to about 11. The test catalyst is 65% zeolite, bound with alumina, and extruded. The feedstocks employed are virgin light naphtha fractions (150°–350° F./65°–165° C.) consisting essentially of C7–C12 hydrocarbons, as set forth in Table F.

TABLE F

| Feedstock (Straight Run Naphtha) | Arab Light Paraffinic Naph | Nigerian Naphthenic Naph |
|---|---|---|
| Boiling Point, °F. | C7-350 | C7-330 |
| API Gravity | 58.6 | 53.4 |
| H, wt % | 14.52 | 14.33 |
| S, wt % | 0.046 | 0.021 |
| N, ppm | 0.3 | 0.5 |
| Composition, wt % | | |
| Paraffins | 65 | 33 |
| Naphthenes | 21 | 57 |
| Aromatics | 14 | 10 |

EXAMPLE 1

Naphtha cracking runs are in a fixed-bed isothermal reactor. In a ⅜" I.D. tubular reactor, 5 grams of various catalysts (14/25 mesh) are heated to about 540° C. (1000° F.) under nitrogen and maintained at this temperature and 450 kPa (50 psig) for 18 hours. To commence the cracking reaction, an Arabian Light $C_6$–350° F. straight run naphtha was charged to the reactor at 6 WHSV. Nitrogen flow rate is maintained sufficient for contact times of approximately 1 second. Liquid is fed to the reactor for 30 minutes, followed by 30 minutes of nitrogen purging before resumption of the liquid feed. Conversion values are based on the amount of $C_5$– products produced.

Several zeolite catalysts are evaluated for naphtha cracking in alumina-bound extrudate form containing about 65 wt % zeolite component. The zeolites evaluated have an intermediate pore size from about 5–7 Å including ZSM-5 and ZSM-12 and large pore USY having a pore size of about 8 Å.

The results from naphtha cracking studies are shown in Table 1. At a comparable conversion level of 43 wt %, ZSM-12 and ZSM–5 exhibit very high selectivity for $C_5$– olefin production (66% $C_2$=C5=), with high desirable iso-olefins for MTBE and TAME (12.5–16.6% $iC_4$ =–$C_5$ =). Large-pore zeolite USY provides lowest light olefin $C_5$– products about 47%.

TABLE 1

Product Distribution Obtained from Selective Cracking of Straight Run Naphtha Over ZSM-5, ZSM-12 and USY

| Catalyst Example | ZSM-5 1A | ZSM-12 1B | USY 1C |
|---|---|---|---|
| $C_5$– Conversion, wt % | 43 | 43 | 48 |
| Product Selectivity, wt % | | | |
| $C_2$= | 11.4 | 5.1 | 3.9 |
| $C_3$= | 26.7 | 28.5 | 21.9 |
| $C_4$= | 21.2 | 24.1 | 15.8 |
| $C_5$= | 6.3 | 8.3 | 5.6 |
| Total $C_2$=–$C_5$= | 65.6 | 66.0 | 47.2 |
| Total $iC_4$=–$iC_5$= | 12.5 | 16.6 | 9.3 |
| Total $iC_4$–$iC_5$ | 6.7 | 10.8 | 34.3 |
| Total $nC_3$–$C_5$ | 23.0 | 19.5 | 15.8 |
| Total $C_1$–$C_2$ | 5.8 | 3.1 | 2.6 |

EXAMPLE 2

To illustrate the advantage of using large-pore zeolites in a naphtha cracking process followed by isoparaffin dehydrogenation, selectivity obtained with the state-of-the-art dehydrogenation processes (e.g. UOP Oleflex or Phillips STAR) is taken at a maximum value of about 80% from $iC_4$–$iC_5$ to $iC_4$=–$iC_5$=. The overall yields of iso-cracking/dehydrogenation process are shown as follows:

TABLE 2

| | ZSM-5 | ZSM-12 | USY |
|---|---|---|---|
| $C_5$– Conversion, wt % | 43 | 43 | 48 |
| OVERALL YIELDS, wt % | | | |
| Naphtha Cracking | | | |
| Total $iC_4$=–$iC_5$= | 5.4 | 7.1 | 4.5 |
| Total $iC_4$–$iC_5$ | 2.9 | 4.6 | 16.5 |
| Naphtha Cracking/ Dehydrogenation Total $iC_4$=–$iC_5$ | 7.7 | 10.8 | 17.7 |

Thus, the combined naphtha cracking/dehydrogenation process provides higher yields of iso-butylene/isoamylene than those obtained from naphtha cracking alone. However, the use of large-pore zeolites in naphtha cracking step enhances the yields of the desirable iso-olefins for MTBE/TAME production.

The process may be optimized by zeolite catalysis to produce maximum total isomeric aliphatics. Selective naphtha cracking has shown to be an attractive process to produce various light olefins for ether manufacture. However, the combined naphtha cracking/dehydrogenation process enhances the production of iso-olefins for MTBE/TAME manufacture, thus providing cost-effective alternative to naphtha reforming for the production of clean fuels, particularly if limitations are placed on the aromatic level of gasoline pool.

Fluidized bed configuration is preferred in the primary stage cracking reaction, particularly at high temperature (800°-1200° F.) and short-contact time (<10 sec) conditions, preferably at 0.5 to 5 second catalyst contact. The "fast fluidized" bed reactory type is particulary advantageous in that the contact time can be controlled by design and operation of the riser portion of the reactor, with catalyst regeneration and recirculation being achieved in a continuous reactor operation. Moving-bed and fixed-bed reactors are also viable for high activity and stable catalysts which might not require frequent regeneration. Prefered process conditions for moving bed or fluidized bed configuration would be at reaction temperature of 425° C. to 600° C. (800°-1112° F.), low space velocities (0.25-3 WHSV) and in the substantial absence of added hydrogen. Relatively small amounts of hydrogen may be added in fixed bed reactors to prevent excessive coke formation.

EXAMPLE 3

Several runs are made at about 500°-540° C. (960°-1000° F.), averaging 1-2 seconds contact time at WHSV 1-4, based on total catalyst solids in a fixed bed reactor unit at conversion rates from about 20-45%. Results are given in Table 3, which shows the detailed product distribution obtained from cracking these raw naphtha over ZSM-12 catalyst (65% zeolite, 35% alumina binder, 11 alpha) in a fixed-bed catalytic reactor at 35 psig N2 atmosphere.

TABLE 3

| | Selective Naphtha Cracking Over ZSM-12 | | | | | |
|---|---|---|---|---|---|---|
| Run# | 1 | 2 | 3 | 4 | 5 | 6 |
| SR Naphtha | Arab Light - - -

TABLE 4-continued

| | SRN CRACKING-REFORMING | | | | | | | | |
|---|---|---|---|---|---|---|---|---|---|
| CASE | BASE | BASE | BASE | ZSM-12 | | | USY | | |
| $C_6$+ Arom. Vol. % | 47.6 | 36.1 | 52.4 | 47.8 | 52.0 | 56.8 | 57.6 | 50.8 | 55.8 |
| $C_5$+ Yield Vol. % | 80.5 | 89.4 | 76.7 | 87.9 | 84.6 | 80.7 | 81.1 | 84.3 | 80.1 |
| RIT, °F. | 937 | 879 | 961 | 881 | 901 | 926 | 949 | 923 | 910 |
| LHSV | 1.0 | 1.0 | 1.0 | 0.5 | 0.5 | 0.5 | 1.0 | 0.5 | 0.5 |
| Total Arom. TBD | 20.9 | 15.9 | 23.0 | 10.5 | 11.4 | 12.5 | 12.7 | 11.2 | 12.3 |

TABLE 4A

| Reforming Estimates: Reforming vs. Naphtha Cracking/Reforming | | | |
|---|---|---|---|
| | REFORMING | NAPHTHA CRACKING/REFORMING | |
| Feedstock | Base Case Naphtha | ZSM-12 Unc. Naphtha | USY Unc. Naphtha |
| Octane, R + O | 100 | 100 | 100 |
| RxR Temp, °F. | 962 | 926 | 911 |
| LHSV | 1.0 | 0.5 | 0.5 |
| Throughput, BPD | 20,000 | 11,400 | 10,400 |
| $C_5$+ Yield, vol % | 76.7 | 80.7 | 80.1 |
| $C_6$+ Aromatics, vol % | 52 | 57 | 56 |
| Total Aromatics, BPD | 10,400 | 6,498 | 5,824 |

Selective naphtha cracking has shown to be an attractive process to produce light olefins for various ether manufacture. The combined naphtha cracking/reforming process provides a cost-effective alternative to naphtha reforming alone for the production of clean fuels, particularly if limitations are placed on the aromatic level of gasoline pool.

This process deals with the need to get higher octane number out of a virgin naphtha and "converted naphtha", such as FCC cracked naphtha and thermally cracked naphtha, without increasing the aromatics content of the gasoline pool. The naphtha is fed to a moderate pressure bed of porous solid catalyst, such as ZSM-5 type zeolites, to convert mainly low octane paraffins and olefins to isomeric intermediate olefins, which are fed to an etherification unit to produce ethers. There is an increased source of olefins for etherification, while producing a smaller net amount of reformer charge. This allows an increase in the severity or yield from the reformer. Paraffins that are normally converted to aromatics and light paraffins are converted instead to intermediate convertible olefins and subsequently to ethers.

The secondary reformer of this invention is fed a lower paraffin content charge stock. Consequently, paraffin aromatization requirements and reformate hydrocracking requirements (usually in a third or fourth reformer reactor CCR section) are reduced, giving a higher hydrogen concentration in the reformer recycle/off gas and a charge stock easier to reform to the same octane as before or more reformer to hit the feed harder.

Various modifications can be made to the system, especially in the choice of equipment and non-critical processing steps. While the invention has been described by specific examples, there is no intent to limit the inventive concept as set forth in the following claims.

We claim:

1. A process for upgrading paraffinic naphtha to high octane fuel comprising:

contacting a fresh naphtha feedstock stream containing a major amount of $C_7$+ alkanes and naphthenes with medium pore acid cracking catalyst under low pressure selective cracking conditions effective to produce C4–C5 isoalkene amd C4–C5 isoalkane, said cracking catalyst being substantially free of hydrogenation-dehydrogenation metal components and having an acid cracking activity less than 15;

separating cracking effluent to obtain an olefinic fraction rich in C4–C5 isoalkene and a C6+ fraction;

etherifying the C4–C5 isoalkene fraction by catalytic reaction with lower alkanol to produce tertiary-alkyl ether product; and reforming the C6+ fraction to provide high octane gasoline components.

2. A process for upgrading paraffinic naphtha to high octane fuel according to claim 1 wherein the fresh feedstock contains at least 20 wt % C7–C12 alkanes, at least 15 wt % C7+ cycloaliphatic hydrocarbons, and less than 40% aromatics; the cracking conditions include total pressure up to about 500 kPa, space velocity greater than 1/hr WHSV, and reaction temperature of about 425° to 650° C.; the cracking catalyst comprises medium or large pore metallosilicate zeolite having a constraint index of about 0.4 to 12; and wherein the cracking reaction produces less than 5% C2− light gas based on fresh naphtha feedstock.

3. A process for upgrading naptha comprising predominantly alkanes and/or naphthenes according to claim 2 wherein the cracking catalyst comprises medium pore zeolite; the cracking reaction is maintained at about 450° to 540° C. and weight hourly space velocity of about 0.5 to 100/hr; and wherein the fresh feedstock consists essentially of C7+ paraffinic virgin petroleum naphtha boiling in the range of about 65° to 175° C.

4. A process for upgrading paraffinic naphtha to high octane fuel comprising:

contacting a fresh paraffinic petroleum naphtha feedstock stream having a normal boiling range of about 65° to 175° C. with a first fluidized bed of medium pore acid zeolite cracking catalyst under low pressure selective cracking conditions effective to produce at least 10 wt % selectivity C4–C5 isoalkene, said cracking catalyst being substantially free of hydrogenation-dehydrogenation metal components and having an acid cracking activity less than 15;

separating cracking effluent to obtain a light olefinic fraction rich in C4–C5 isoalkene and a C6+ liquid fraction;

etherifying the C4–C5 isoalkene fraction and additional isobutene and isopentene by catalytic reaction with lower alkanol to produce tertiary-alkyl ether product; and reforming the C6+ liquid fraction by contact with a hydrogenation/dehydrogenation reforming catalyst under reforming conditions.

5. A process for upgrading paraffinic naphtha to high octane fuel according to claim 4 wherein the fresh feedstock contains about C7C10 alkanes cycloaliphatic hydrocarbons, and is substantially free of aromatics; the cracking conditions include total pressure up to about 500 kPa and reaction temperature of about 425° to 650° C.; the cracking catalyst comprises metallosilicate zeolite having a constraint index of about 0.4 to 12; and wherein the cracking reaction produces less than 5% C2— light gas based on fresh naphtha feedstock.

6. A process for upgrading paraffinic naphtha to high octane fuel according to claim 5 wherein the cracking catalyst comprises medium pore zeolite; the cracking reaction is maintained at about 450° to 540° C. and weight hourly space velocity of about 1 to 4; and including the additional step of recovering volatile unreacted isoalkene and alkanol from etherification effluent and contacting the volatile effluent with a second fluidized bed of medium pore acid zeolite catalyst under olefin upgrading reaction conditions to produce additional gasoline range hydrocarbons.

7. A process for upgrading paraffinic naphtha to high octane fuel according to claim 4 wherein cracking effluent is fractionated to obtain a $C_6$+ fraction, and at least a portion of the $C_6$+ fraction from cracking effluent is recycled with fresh feedstock for further conversion under cracking conditions; and wherein isobutene and isoamylene recovered from naphtha cracking are etherified with methanol to produce methyl t-butyl ether and methyl t-amyl ether.

8. A process for upgrading paraffinic naphtha to high octane fuel comprising:

contacting a fresh naphtha feedstock stream containing a major amount of $C_7$+ alkanes and naphthenes with medium pore acid cracking catalyst under low pressure selective partial cracking-dehydrogenation conditions effective to produce at least 10 wt % selectivity $C_4$–$C_5$ isoalkene while recovering a major amount of C6+ hydrocarbons, said cracking catalyst having an acid cracking activity less than 15; wherein the fresh feedstock contains at least about 20 wt % $C_7$–$C_{12}$ alkanes, at least about 15 wt % $C_7$+ cycloaliphatic hydrocarbons, and less than 40 wt % aromatics; the cracking conditions include total pressure up to about 500 kPa, space velocities greater than 1/hr WHSV, and reaction temperature of about 425° to 650° C.; the cracking catalyst comprises metallosilicate zeolite having a constraint index of about 1 to 12; and wherein the cracking reaction produces less than 5% $C_2$– light gas based on fresh naphtha feedstock;

separating cracking effluent to obtain a light olefinic fraction rich in $C_4$–$C_5$ isoalkene and a C6+ normally liquid fraction;

etherifying the $C_4$–$C_5$ isoalkene fraction by catalytic reaction with lower alkanol to produce tertiary-alkyl ether product; and contacting the $C_6$+ normally liquid fraction with reforming catalyst under moderate reforming conditions at elevated temperature to obtain a reformate product of enhanced octane value.

9. A process for upgrading naphtha comprising naphthenes according to claim 8 wherein the cracking catalyst consists essentially medium pore metallosilicate; the cracking reaction is maintained at about 450° to 540° C. and weight hourly space velocity of about 1 to 100/hr; and wherein the fresh feedstock consists essentially of $C_7$+ paraffinic virgin petroleum naphtha boiling in the range of about 65° to 175° C.

10. A process for upgrading paraffinic naphtha to high octane fuel according to claim 8 wherein cracking effluent is fractionated to obtain a $C_6$+ fraction, and at least a portion of the $C_6$+ fraction from cracking effluent is recycled with fresh feedstock for further conversion under cracking conditions; and wherein isobutene and isoamylene recovered from naphtha cracking are etherified with methanol to produce methyl t-butyl ether and methyl t-amyl ether.

11. A process for upgrading paraffinic naphtha to high octane fuel by contacting a fresh virgin naphtha feedstock stream consisting essentially of $C_7$–$C_{12}$ alkanes and naphthenes with a fluidized bed of solid medium pore acid zeolite cracking catalyst under low pressure selective cracking conditions effective to convert up to about 45 wt % of feedstock alkanes and naphthenes with at least 10 wt % selectivity to $C_4$–$C_5$ isoalkene;

separating cracking effluent to obtain a light olefinic fraction rich in $C_4$–$C_5$ isoalkene and a $C_6$+ liquid fraction of enhanced octane value containing less than 50 wt % aromatic hydrocarbons; and contacting the $C_6$+ normally liquid fraction with reforming catalyst under moderate reforming conditions at elevated temperature to obtain a reformate product of enhanced octane value.

12. A process for upgrading paraffinic naphtha to high octane fuel according to claim 11 wherein the fresh feedstock contains at least 15 wt % C7–C12 cycloaliphatic hydrocarbons and less than 20% aromatics; the cracking conditions include total pressure up to about 500 kPa and reaction temperature of about 425° to 650° C.; the cracking catalyst comprises medium pore aluminosilicate zeolite having the structure of ZSM-12, said cracking catalyst being substantially free of hydrogenation-dehydrogenation metal components and having an acid cracking activity less than 15.

13. A process for upgrading paraffinic naphtha to high octane fuel according to claim 11 wherein the $C_6$+ liquid fraction is hydrotreated prior to reforming.

14. A process for upgrading paraffinic naphtha to high octane fuel by contacting a fresh virgin naphtha feedstock stream consisting essentially of C7–C12 alkanes and naphthenes with a fluidized bed of solid porous large pore acid zeolite cracking catalyst under low pressure selective cracking conditions efffective to produce at least 10 wt % C4–C5 isoalkene, said cracking catalyst being substantially free of hydrogenation-dehydrogenation metal components and wherein the fluidized bed catalyst is contacted with the feedstock in a vertical riser reactor in a transport fluidization regime during a short contact period which is sufficient to convert about 15 to 40 wt % of feedstock with selectivity of at least 10% $C_4$–$C_5$ isoalkene;

separating cracking effluent to obtain a light olefinic fraction rich in C4–C5 isoalkene and a C6+ liquid fraction of enhanced octane value containing less than 20 wt % aromatic hydrocarbons; and reforming the C6+ fraction to provide high octane gasoline components.

15. A process for upgrading paraffinic naphtha to high octane fuel according to claim 14 wherein the fresh feedstock contains at least 15 wt % C7+ cycloaliphatic hydrocarbons and less than 20% aromatics; the cracking conditions include total pressure up to about 500 kPa and reaction temperature of about 425° to 650° C.; the cracking catalyst comprises aluminosilicate zeolite having an acid cracking activity less than 15.

16. A process for upgrading paraffinic naphtha to high octane fuel according claim 15 wherein petroleum naphtha containing aromatic hydrocarbon is hydrotreated to convert aromatic components to cycloaliphatic hydrocarbons to provide fresh feedstock containing less than 5 wt % aromatics.

17. The process of claim 16 wherein said cracking reaction is carried out in the substantial absence of added hydrogen; wherien the contact period is less than 10 seconds; and wherein the space velocity is greater than 1, based on active zeolite catalyst solids.

* * * * *